US008430394B2

(12) United States Patent
Uehara

(10) Patent No.: US 8,430,394 B2
(45) Date of Patent: Apr. 30, 2013

(54) SHEET FEEDING DEVICE AND IMAGE FORMING APPARATUS

(75) Inventor: Junji Uehara, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/034,091

(22) Filed: Feb. 24, 2011

(65) Prior Publication Data

US 2011/0204560 A1 Aug. 25, 2011

(30) Foreign Application Priority Data

Feb. 24, 2010 (JP) ..... 2010-038710

(51) Int. Cl.
*B65H 3/06* (2006.01)
*B65H 1/26* (2006.01)

(52) U.S. Cl.
USPC ..... 271/117; 271/118; 271/162; 271/164

(58) Field of Classification Search ..... 271/117, 271/118, 124, 162, 164
See application file for complete search history.

(56) References Cited

U.S. PATENT DOCUMENTS

2005/0179192 A1 8/2005 Miura et al.
2005/0180797 A1* 8/2005 Hattori ..... 400/624

FOREIGN PATENT DOCUMENTS

JP 59153737 A * 9/1984
JP 63212629 A * 9/1988
JP 3195638 A 8/1991
JP 7206185 A 8/1995
JP 10245131 A 9/1998
JP 2001-080759 3/2001
JP 2002-249242 9/2002
JP 2005231751 A 9/2005
JP 2006076692 A 3/2006

OTHER PUBLICATIONS

Notice of Reasons for Rejection for Japanese patent application No. 2010-038710 mailed Oct. 4, 2011.

* cited by examiner

*Primary Examiner* — Luis A Gonzalez
(74) *Attorney, Agent, or Firm* — Banner & Witcoff, Ltd.

(57) ABSTRACT

A sheet feeding device includes a sheet cassette which accommodates stacked sheets. The sheet feeding device further includes a pickup roller, a separation pad, a separating roller pressing the sheet against the separating pad and a holder arm which holds the pickup roller and the separating roller. The sheet feeding device still further includes an urging member configured to urge the separating roller toward the separating pad and includes a supporting portion configured to support a specific portion of the holder arm. When the sheet cassette is removed, the support portion supports the specific portion of the holder arm at a supporting position and the pickup roller is positioned at an upper position.

13 Claims, 8 Drawing Sheets

SHEET FEEDING DEVICE AND IMAGE FORMING APPARATUS

CROSS REFERENCE TO RELATED APPLICATION

This application claims priority from Japanese Patent Application No. 2010-038710, which was filed on Feb. 24, 2010, the entire subject matter of which is incorporated herein by reference.

BACKGROUND

1. Technical Field

Aspects of the invention relate to a sheet feeding device configured to feed stacked sheets one by one and an image forming apparatus including the sheet feeding device.

2. Related Art

A known sheet feeding device includes a pickup roller which pivots to contact with the sheets, and includes a lift-up motor which lifts up the pickup roller when inserting and removing the paper feed cassette. The pickup roller is moved to be retracted by the lift-up motor so as not to interfere the insertion or the removal of the paper feed cassette.

However, in this configuration, total manufacturing cost of the sheet feeding device may be high because a cost of the motor is high. Additionally, the control of the lift-up motor may be complicated.

Another known sheet feeding device includes a pickup roller which pivots to contact with the sheets, and includes a lever or the like in conjunction with which the pickup roller moves. When inserting and removing the paper feed cassette, the lever or the like engages a paper feed cassette to retract the pickup roller to a retracted position so as not to interfere the insertion or the removal of the paper feed cassette.

However, in this configuration, total manufacturing cost of the sheet feeding device may be high because a mechanism for retracting the pickup roller at the retracted position is complicated. This complicated configuration may cause a high cost for manufacturing.

SUMMARY

A need has arisen to provide a sheet feeding device and an image forming apparatus which may have simple configuration and which may be manufactured in a reduced cost.

According to aspects of the invention, a sheet feeding device includes a sheet cassette including a placing portion configured to accommodate the stacked sheets. The sheet feeding device further includes a pickup roller configured to feed the stacked sheets one by one by rotating and a separating pad configured to apply a predetermined transporting resistance to the fed sheet. The sheet feeding device still further includes a separating roller configured to contact with the sheet fed by the pickup roller and to press the sheet against the separating pad. Moreover, the sheet feeding device still further includes a holder arm which holds the pickup roller and the separating roller. The holder arm is configured to pivot about a rotational axis of the separating roller when the sheet cassette is mounted. The sheet feeding device further includes an urging member configured to urge the separating roller toward the separating pad and a supporting portion configured to support a specific portion of the holder arm positioned between the pickup roller and the separating roller. When the sheet cassette is removed, the support portion supports the specific portion of the holder arm at a supporting position and the pickup roller is positioned at an upper position corresponding to the supporting position where the specific portion of the holder arm is supported.

BRIEF DESCRIPTION OF THE DRAWINGS

Illustrative aspects of the invention will be described in detail with reference to the following figures wherein.

DETAILED DESCRIPTION

It is noted that various connections are set forth between elements in the following description. It is noted that these connections in general and, unless specified otherwise, may be direct or indirect and that this specification is not intended to be limiting in this respect.

1. General Configuration of Image Forming Apparatus

Figure 1:
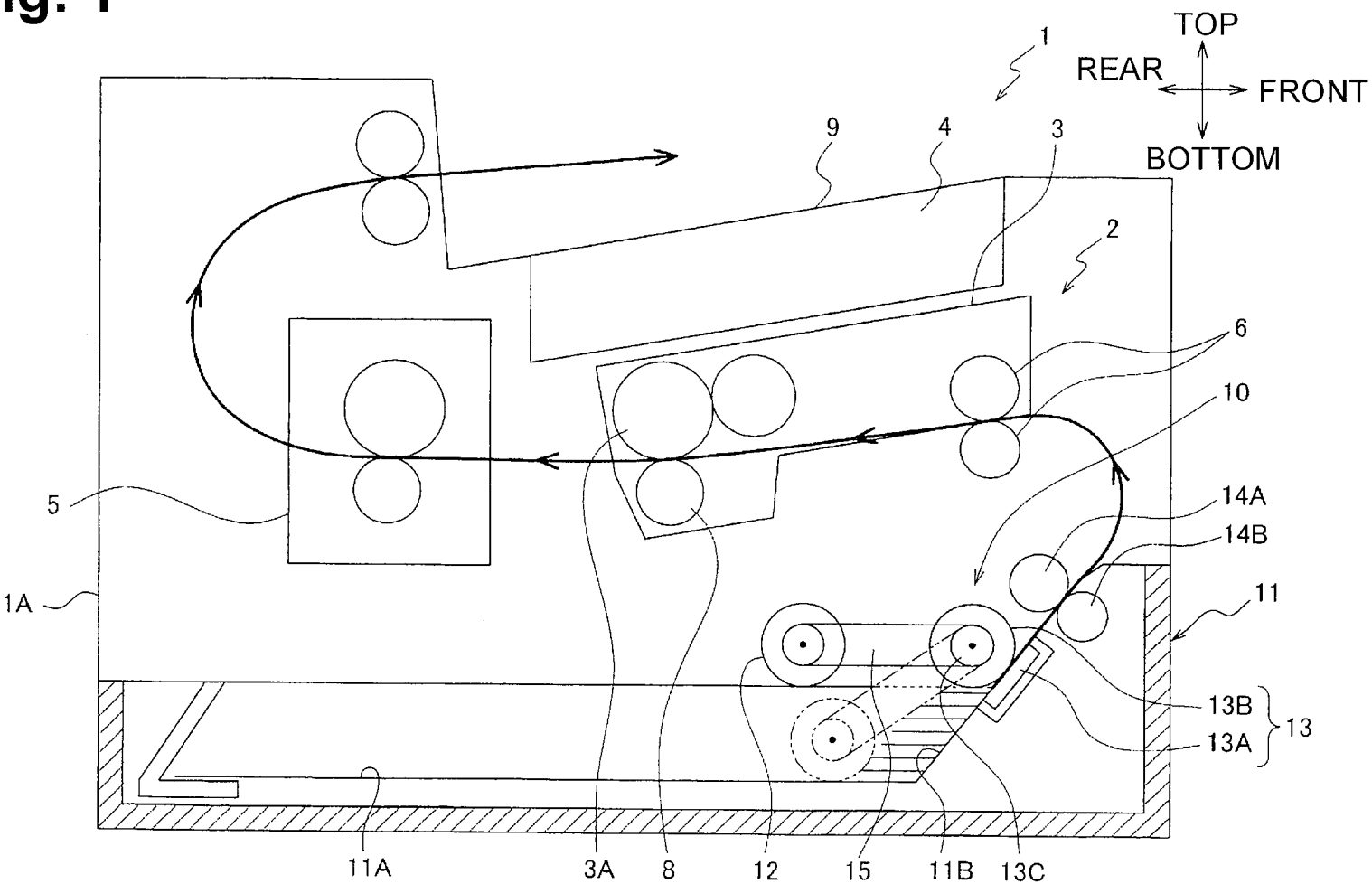
FIG. 1 is a schematic drawing showing a center cross-section of an image forming apparatus.

According to one aspect of the disclosure, an image forming apparatus 1 includes an image forming unit 2 and a paper feed device 10 (an example of a sheet feed device) as shown in FIG. 1. The image forming unit 2 is configured to form (print) an image on paper or an OHP sheet (hereinafter referred to as "paper"), and the paper feed device 10 is configured to feed the paper to the image forming unit 2.

The image forming unit 2 is configured with an electrophotographic-type image forming unit including a process cartridge 3, an exposing unit 4, and a fixing unit 5. The process cartridge 3 includes a photosensitive drum 3A configured to carry a developer image, and a charger (not shown) configured to charge the photosensitive drum 3A.

Then, the paper fed from the paper feed device 10 toward the image forming unit 2 is transported to a pair of registration rollers 6 and is transported to the photosensitive drum 3A after having corrected in skew by the pair of registration rollers 6. In contrast, the charged photosensitive drum 3A is exposed by the exposing unit 4. After having formed a static latent image on the outer peripheral surface thereof, the developer (for example, powdered toner) is supplied to the photosensitive drum 3A, so that the developer image is carried (formed) on the outer peripheral surface of the photosensitive drum 3A.

An electric charge having an opposite polarity from the developer is applied to a transfer roller 8 disposed on the opposite side of the photosensitive drum 3A with respect to the transported paper, and the developer image carried on the photosensitive drum 3A is transferred to the paper by the transfer roller 8.

The fixing unit 5 is configured to fix the developer transferred to the paper thereto by heating the paper after having transferred the developer image. The paper discharged from the fixing unit 5 and having completed the image formation thereon is redirected upward in the direction of transport and then is discharged onto a paper discharge tray 9 provided on the side of an upper end surface of the image forming apparatus 1.

2. Detailed Structure of Paper Feed Device

As shown in FIG. 1, the paper feed device 10 is configured to separate a paper positioned at an end in the stacking direction (for example, at a topmost end in the vertical direction) from among a plurality of papers placed on a placing portion 11A of a paper feed cassette 11 (an example of a sheet cassette) in the stacked state, and transport and supply the separated paper one by one toward the image forming unit 2, and the paper feed cassette 11 is demountably mounted to an apparatus body (body frame, a housing, etc.) 1A including the image forming unit 2 built therein in the horizontal direction (for example, the fore-and-aft direction).

A pickup roller 12 is configured to feed the paper by coming into contact with a paper placed on the placing portion 11A and positioned at the topmost end and rotating thereon. A separating mechanism 13 configured to separate a plurality of papers fed by the pickup roller 12 and supply the separated paper to the pair of registration rollers 6 is provided on the downstream side of the pickup roller 12 in the paper transporting direction.

The separating mechanism 13 includes a separating pad 13A and a separating roller 13B arranged at a position opposing the separating pad 13A. The separating pad 13A is a separation resister configured to come into contact with the paper fed by the pickup roller 12 from the opposite side from the pickup roller 12 (for example, the side of a printing surface) and applies a predetermined transporting resistance to the paper. The separating roller 13B includes a separation rotating body configured to come into contact with the paper from the same side as the pickup roller 12 (for example, the opposite side from the printing surface) and rotating the paper while pressing the paper against the separating pad 13A.

Figure 2:
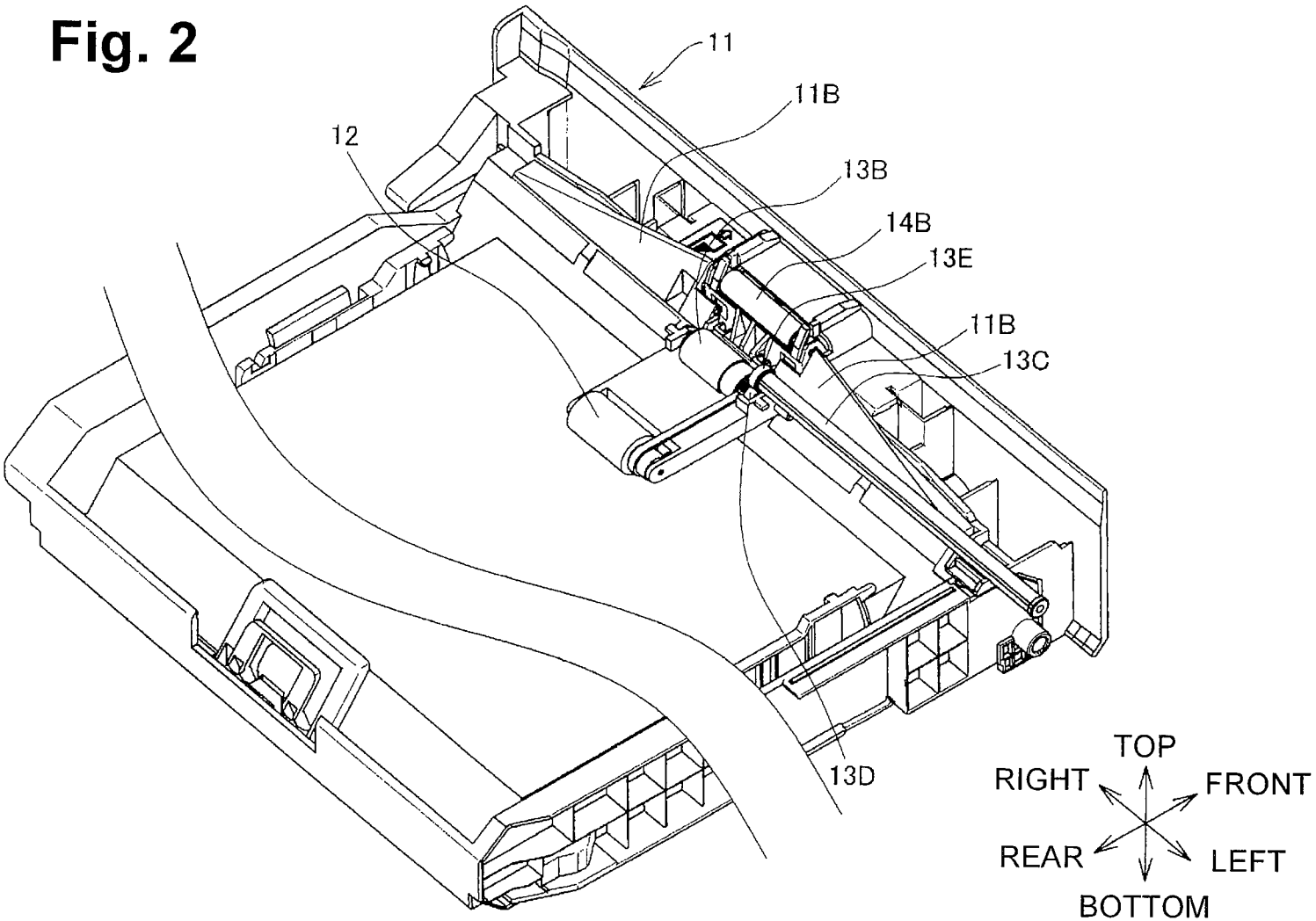
FIG. 2 is a perspective view of a paper feed cassette viewed from above.

The separating roller 13B is located at a substantially center portion of the paper feed cassette 11 in the width direction as shown in FIG. 2, and rotates upon receipt of a rotating force from a drive shaft 13C. In contrast, the separating pad 13A is pivotably assembled to a paper guide portion 11B of the paper feed cassette 11 at a position corresponding to the separating roller 13B.

The drive shaft 13C extends from an end on one side (for example, left side) in the width direction to the separating roller 13B in a state of being rotatably assembled to the apparatus body 1A, and a drive gear 13E which engages a driven gear 13D provided at an end of the separating roller 13B in the axial direction is provided at an end on the side of the separating roller 13B.

The width direction of the paper feed cassette 11 (hereinafter, abbreviated as "width direction") indicates a direction orthogonal to a paper feeding direction (for example, fore-and-aft direction) in the horizontal direction and may correspond to the lateral direction of the image forming apparatus 1.

The paper guide portion 11B is formed into a widening wall shape extending from a bottom portion of the placing portion 11A toward the separating pad 13A, and constitutes a sheet guide unit configured to come into contact with the paper fed by the pickup roller 12 from the opposite side of the pickup roller 12 to guide the transport of the paper. The paper guide portion 11B is provided with a pinch roller 14B configured to come into contact with the paper from the same side as the separating pad 13A and presses the paper against a transporting roller 14A (see FIG. 3) at an end on the downstream side in the paper transporting direction.

The pinch roller 14B is pressed toward the transporting roller 14A by an urging member such as a spring (not shown) in a state of being assembled to the paper feed cassette 11 so as to be displaceable, and the pinch roller 14B is further configured to remove, from the paper, foreign substances such as paper powder generated by frictional contact between the separating pad 13A and the paper.

Figure 3:
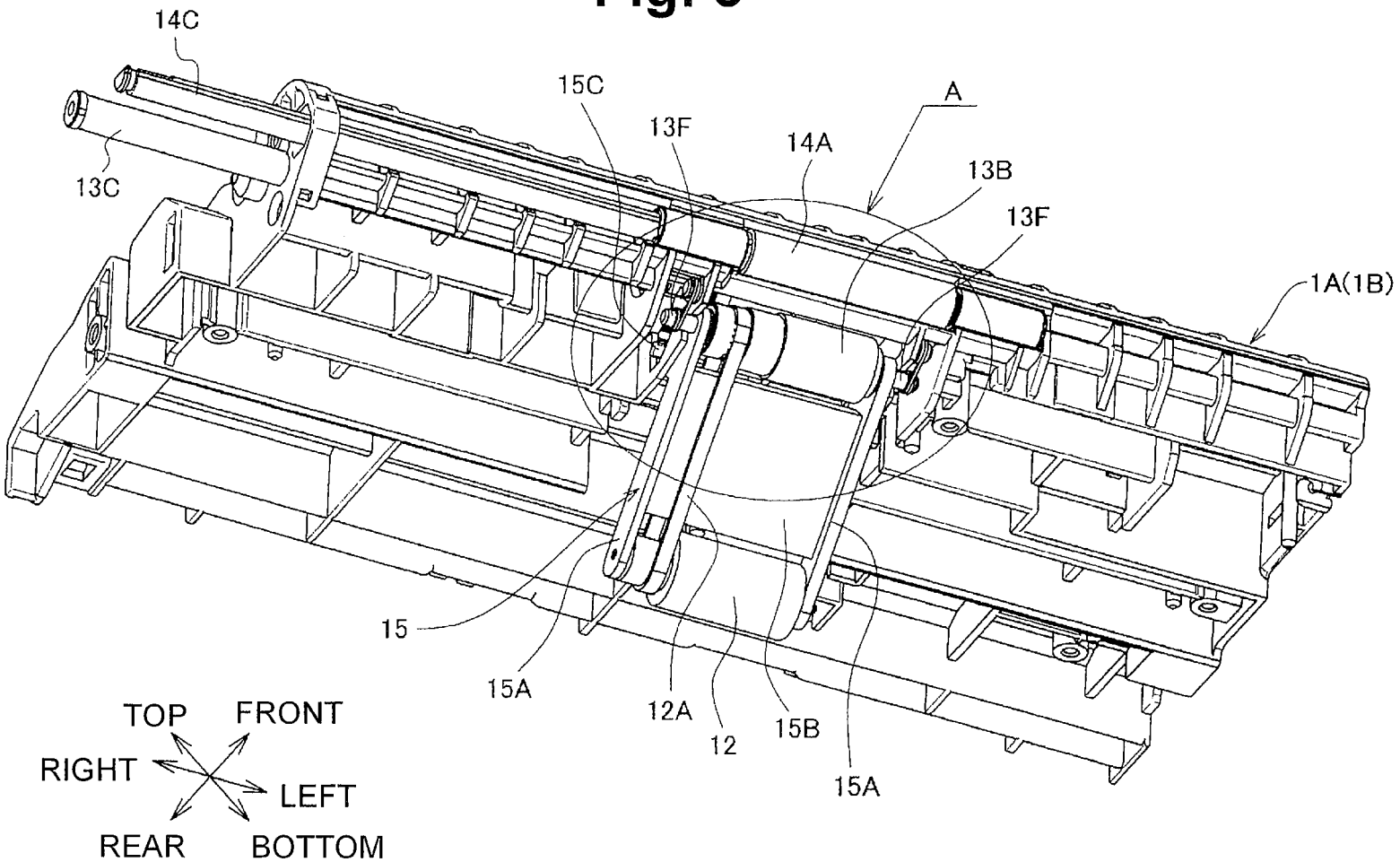
FIG. 3 is a perspective view of a paper feed device viewed from below.

In contrast, as shown in FIG. 3, the transporting roller 14A rotates synchronously with the separating roller 13B upon receipt of a driving force from a drive shaft 14C assembled to the apparatus body 1A (for example, a paper feed frame 1B) so as to be rotatable, and transports the paper discharged from the separating mechanism 13 toward the image forming unit 2 (the registration rollers 6).

A holder arm 15 extends toward the placing portion 11A along the paper transporting direction, and includes the pickup roller 12 rotatably assembled to one end side and the separating roller 13B rotatably assembled to the other end side. The holder arm 15 is pivotable in the paper stacking direction about a rotational axis of the separating roller 13B as the center of pivotal movement.

The holder arm 15 includes side arms 15A rotatably assembled to both ends of a shaft portion 13F of the separating roller 13B in the axial direction and extend toward the pickup roller 12 and a plate-shaped coupling plate 15B coupling the both side arms 15A.

The rotation of the separating roller 13B is transmitted to the pickup roller 12 via a drive belt 12A, and the separating roller 13B and the pickup roller 12 rotate mechanically synchronously in the same direction.

Figure 4:
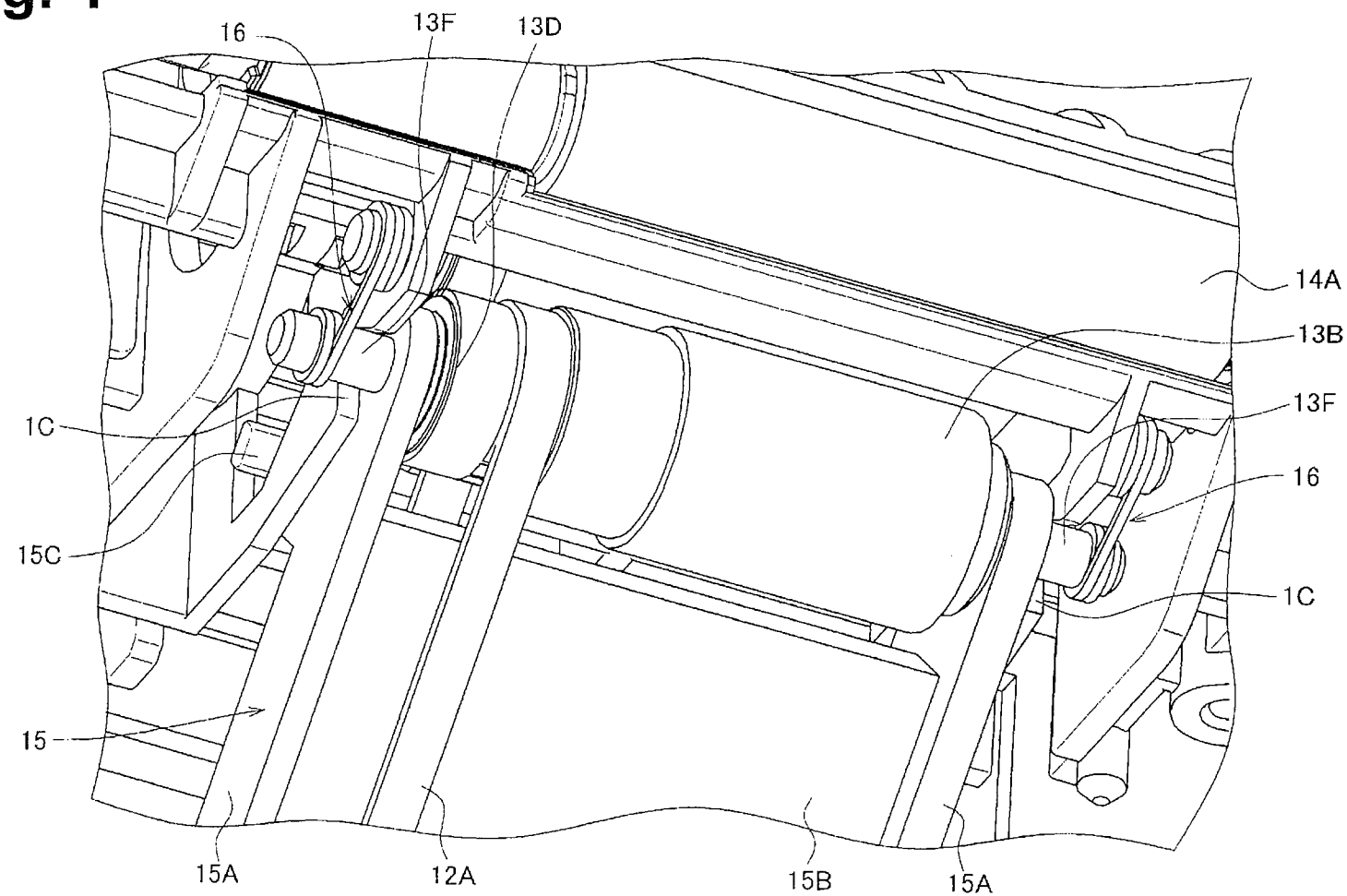
FIG. 4 is a drawing showing a part A in FIG. 3 in an enlarged scale.

The holder arm 15 is assembled to the apparatus body 1A (the paper feed frame 1B) via springs 16 (an example of an urging member) such as torsion springs or leaf springs assembled to the shaft portion 13F as shown in FIG. 4, and the springs 16 apply a pressing force F1 (thick arrows in FIG. 5 or FIG. 6) in the direction from the separating roller 13B toward the separating pad 13A with respect to the shaft portion 13F when the paper feed cassette 11 is mounted on the apparatus body 1A.

In other words, according to aspects of the invention, the holder arm 15 is displaceable with respect to the apparatus body 1A (the paper feed frame 1B), and when the paper feed cassette 11 is mounted to the apparatus body 1A, the separating roller 13B is pressed toward the separating pad 13A by the springs 16.

Figure 5:
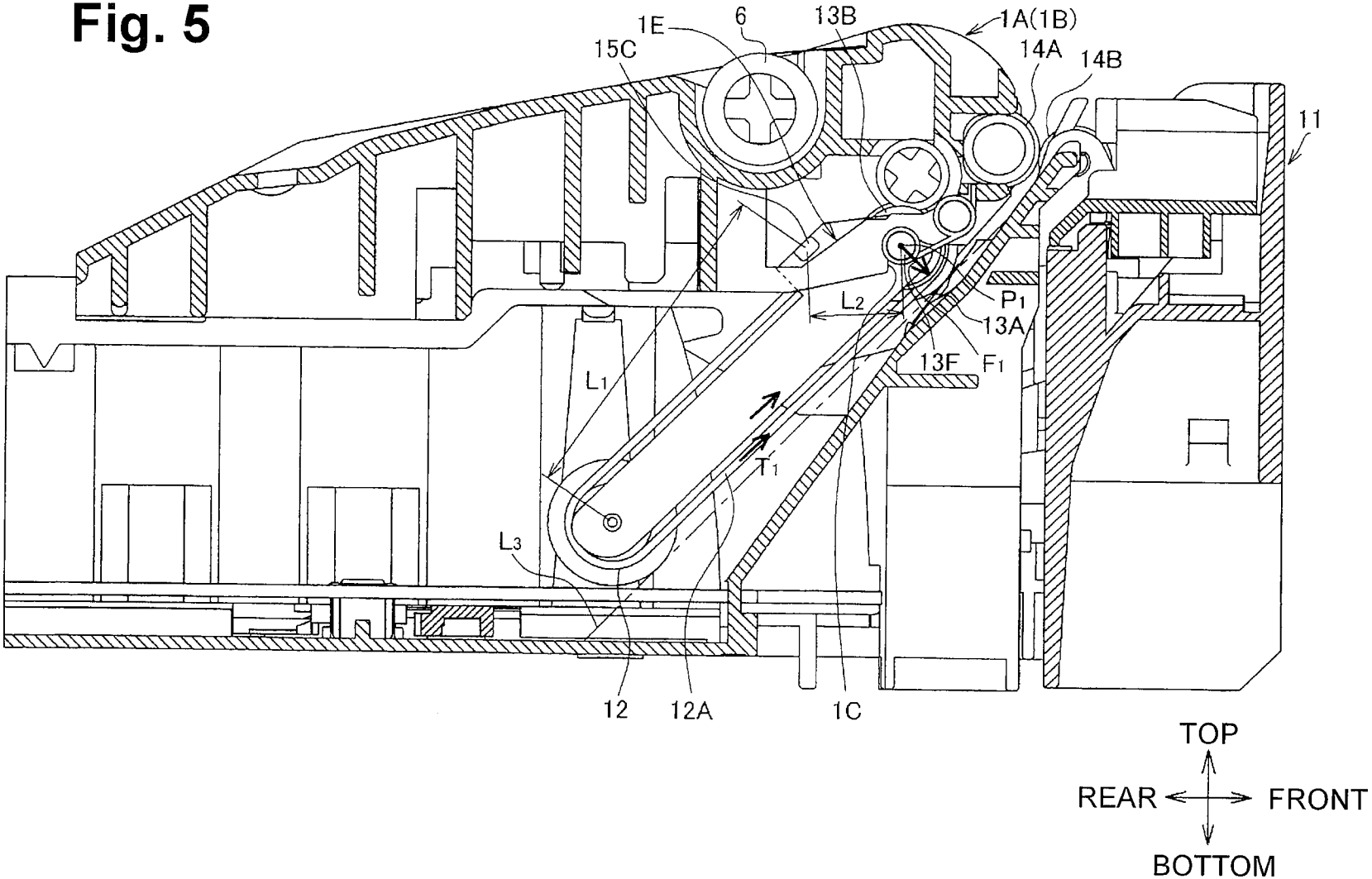
FIG. 5 is a cross-sectional view corresponding to a center cross-section of the image forming apparatus showing a state when the number of sheets is small.
Figure 6:
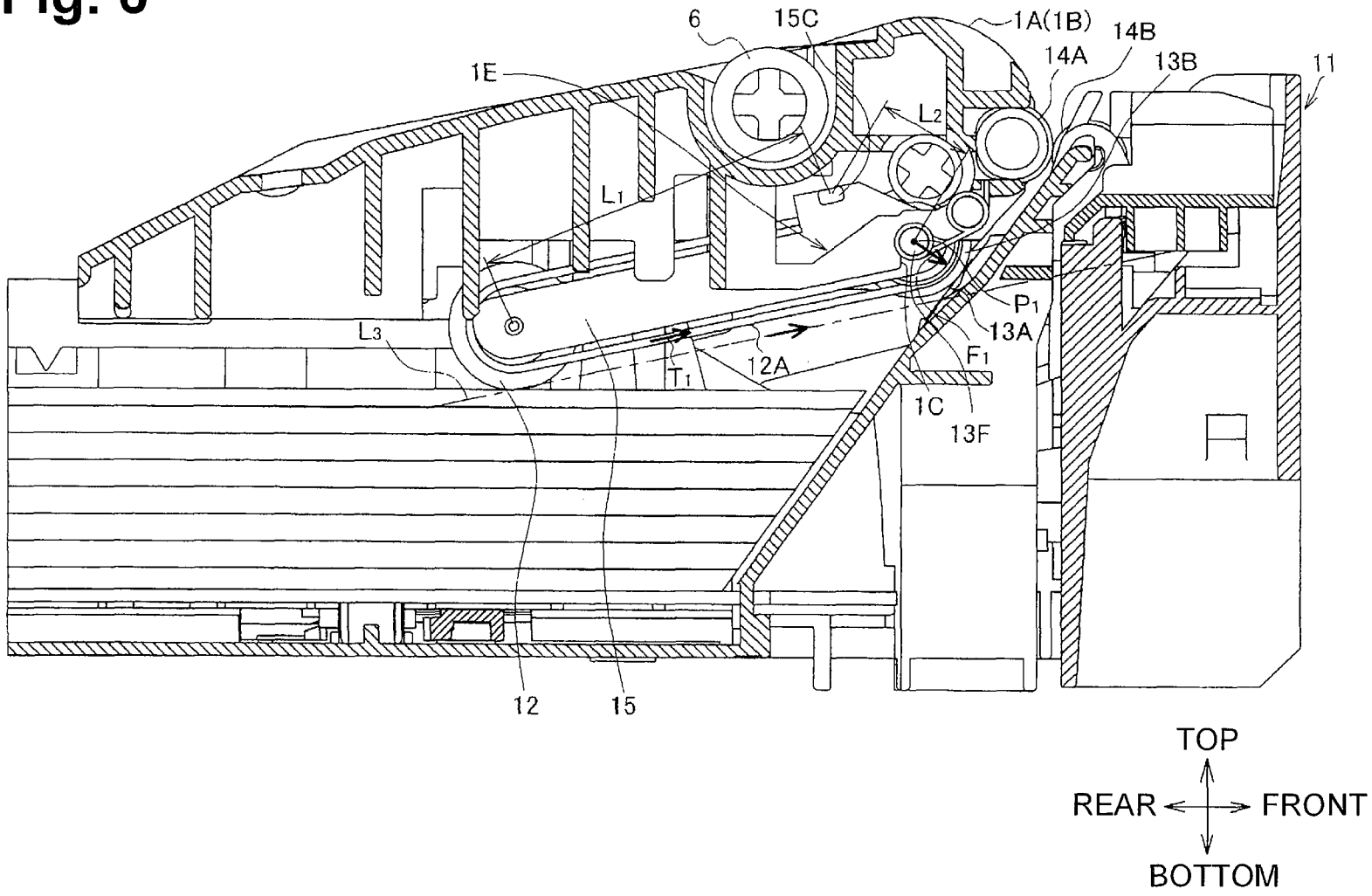
FIG. 6 is a cross-sectional view corresponding to the center cross-section of the image forming apparatus showing a state when the number of sheets is large.

In contrast, as shown in FIGS. 4 to 7, U-shaped depressed portions 1C (an example of a receiving portion) opening on the side of the separating pad 13A are provided on the apparatus body 1A (the paper feed frame 1B) at a position corresponding to the shaft portion 13F. As shown in FIG. 5 or FIG. 6, when the paper feed cassette 11 is mounted on the apparatus body 1A, the shaft portion 13F is fitted into the depressed portions 1C so that the shaft portion 13F is positioned.

In other words, the shaft portion 13F (the holder arm 15) is assembled to the apparatus body 1A (the paper feed frame 1B) via the springs 16. Therefore, when the springs 16 are resiliently deformed, the position of the shaft portion 13F (the holder arm 15) is displaced correspondingly.

Figure 7:
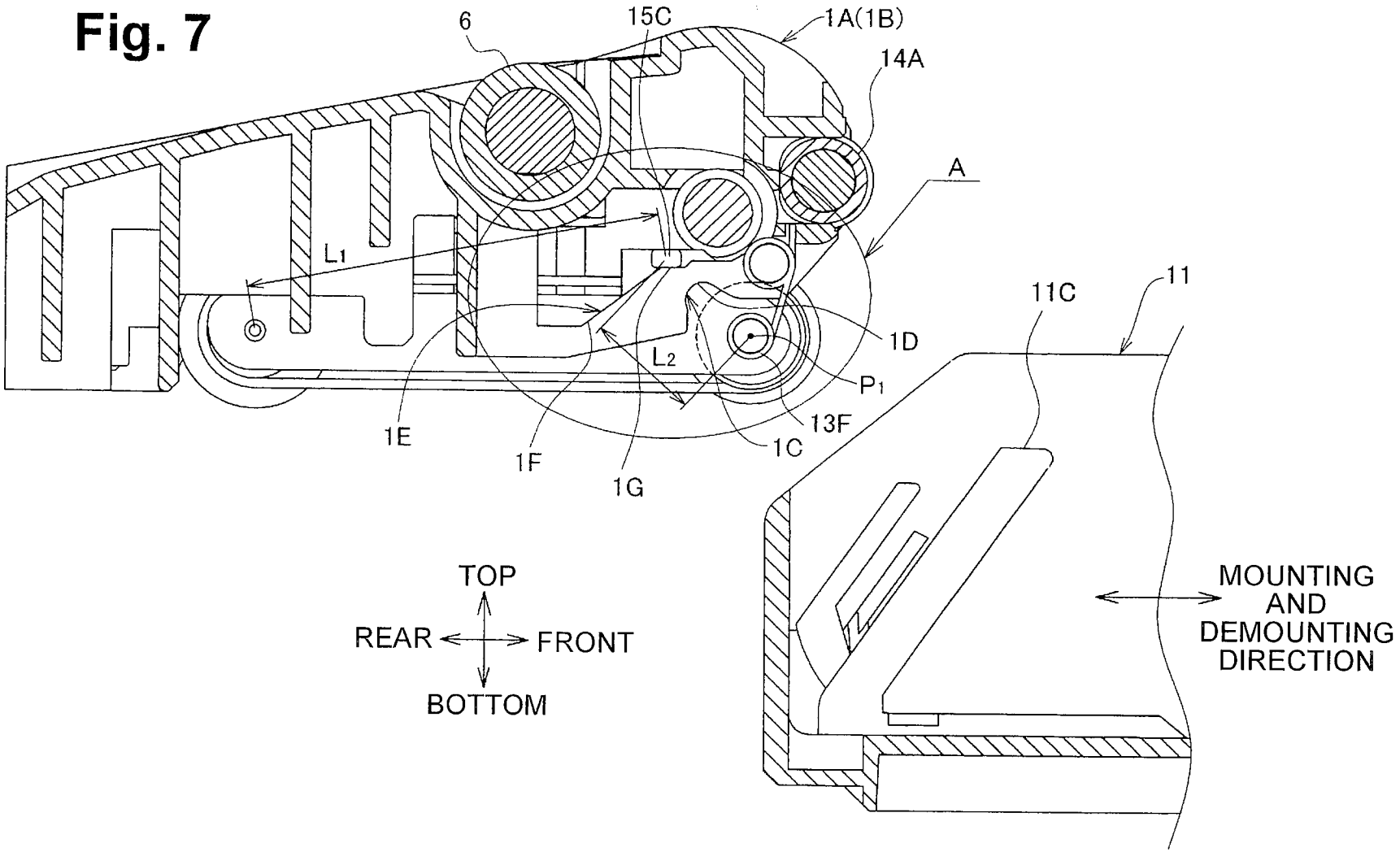
FIG. 7 is a cross-sectional view corresponding to the center cross-section of the image forming apparatus showing a state when the paper feed cassette is removed.

In contrast, when the paper feed cassette 11 is removed from the apparatus body 1A, the springs 16 assume a state in which the resilient deformation is released (see FIG. 7). In contrast, when the paper feed cassette 11 is mounted on the apparatus body 1A, the separating pad 13A presses the separating roller 13B toward the depressed portions 1C, so that the springs 16 assume a resiliently deformed state (see FIG. 5 and FIG. 6). Therefore, when the paper feed cassette 11 is mounted to the apparatus body 1A, the springs 16 apply the pressing force F1 to the shaft portion 13F.

When the paper feed cassette 11 is mounted on the apparatus body 1A, the separating pad 13A presses the separating roller 13B toward the depressed portions 1C and hence the shaft portion 13F is fitted into the depressed portions 1C. Therefore, the shaft portion 13F is pressed against a bottom portion 1D (see FIG. 7) of the depressed portions 1C in a state in which the outer peripheral surface is constrained in three directions by the depressed portions 1C. Therefore, when the paper feed cassette 11 is mounted on the apparatus body 1A, the shaft portion 13F is fitted into the depressed portions 1C and hence is fixed in position.

The holder arm 15 (for example, a pair of side arms 15A) is provided with a projection-shaped supported portion 15C (an example of a specific portion and an example of a protrusion) projecting in the same direction as the shaft portion 13F as shown in FIGS. 5 to 7. In contrast, the apparatus body 1A (the paper feed frame 1B) is provided with supporting portions 1E configured to support the holder arm 15 by coming into contact with the supported portions 15C from below when the paper feed cassette 11 is removed from the apparatus body 1A.

The supported portions 15C are provided on the pair of side arms 15A between the pickup roller 12 and the separating roller 13B at positions such that a distance L1 from the supported portions 15C to the center of rotation of the pickup roller 12 is larger than a distance L2 from the supported portions 15C to a point of action P1 of the pressing force F1 (for example, the shaft portion 13F) irrespective of the state of the holder arm 15.

Figure 8:
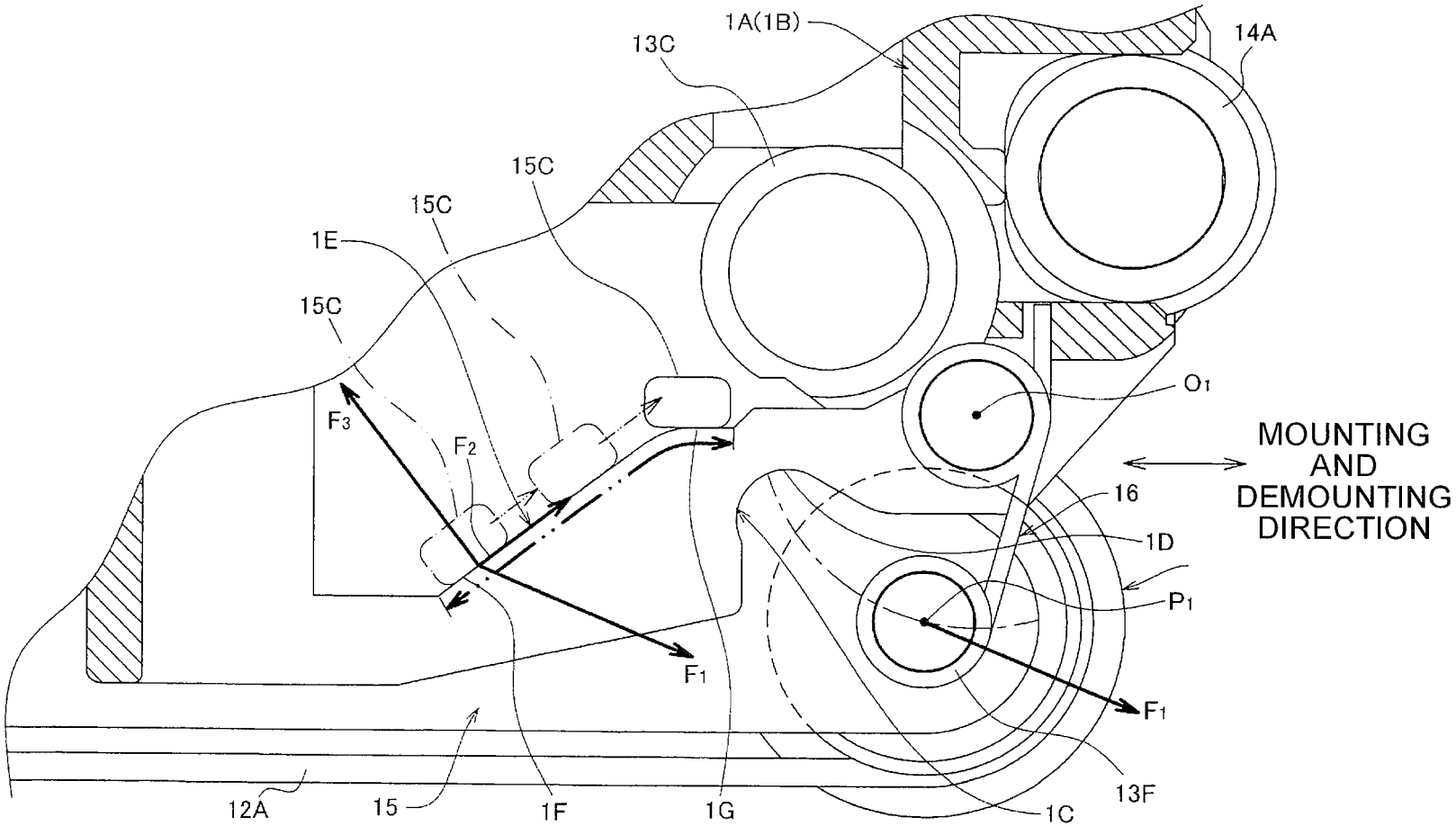
FIG. 8 is a drawing showing a part A in FIG. 7 in an enlarged scale.

In contrast, the supporting portions 1E each include a cam surface (a range indicated by a thick double-dashed chain line in FIG. 8) which comes into contact with the supported portion 15C. When the paper feed cassette 11 is removed from the apparatus body 1A, the supported portions 15C are slid and displaced (guided) on the supporting portions 1E formed of the cam surfaces from the pickup roller 12 toward the separating roller 13B as indicated by a thin-double dashed chain line in FIG. 8.

In other words, the supporting portions 1E each include an inclined surface 1F extending from the pickup roller 12 toward the separating roller 13B in an inclined state with respect to the direction of the pressing force F1, and a horizontal plane 11G continuing smoothly from the inclined surface 1F on the side of the separating roller 13B and extending in the direction parallel to mounting and demounting directions (for example, the horizontal fore-and-aft direction) of the paper feed cassette 11.

When the paper feed cassette 11 is removed from the apparatus body 1A, forces opposing the pressing forces F1 of the springs 16 disappear and the springs 16 are restored. Therefore, the point of action P1 of the pressing force F1, that is, the shaft portion 13F is displaced in the direction away from the depressed portions 1C (the direction toward the lower right of the paper plane) so as to draw a trajectory of an arcuate shape about a torsional center O1 of the springs 16, and the engagement between the drive gear 13E and the driven gear 13D is released.

At this time, the holder arm 15 is also displaced lower right in the paper plane with the displacement of the shaft portion 13F. However, since the center of gravity of the holder arm 15 including the pickup roller 12 is present on the side of the pickup roller 12 with respect to the shaft portion 13F, and the holder arm 15 is pivotable with respect to the shaft portion 13F. Therefore, the supported portions 15C come into contact with the inclined surfaces 1F on the side of the pickup roller 12 first (the state of the left one from among the supported portions 15C indicated by a double-dashed chain line in FIG. 8).

When the supported portions 15C come into contact with the inclined surfaces 1F (the supporting portions 1E), the pressing forces F1 of the springs 16 are received by contact portions between the supported portions 15C and the inclined surfaces 1F. However, since the inclined surfaces 1F are inclined with respect to the direction of the pressing force F1, a component force F2 which is a component parallel to the inclined surfaces 1F with respect to the supported portions 15C is applied, whereby the supported portions 15C are subjected to sliding displacement along the inclined surfaces 1F toward the horizontal plane 11G. A force F3 is a component force having a component orthogonal to the inclined surfaces 1F.

Since the position of the holder arm 15 where the pressing force F1 is applied (the position of the shaft portion 13F) and the contact positions between the supported portions 15C and the supporting portions 1E are shifted, a moment of a couple which causes the holder arm 15 to rotate rightward (clockwise) about the supported portions 15C may be applied to the holder arm 15.

Therefore, if the paper feed cassette 11 is removed from the apparatus body 1A, the supported portions 15C are subjected to the sliding displacement along the inclined surfaces 1F while the holder arm 15 pivots rightward about the supported portions 15C as the center of pivotal movement. Therefore, the pickup roller 12 located on the opposite side from the point of action P1 with respect to the supported portions 15C as the center of pivotal movement is retracted toward the apparatus body 1A (the paper feed frame 1B) so as to move away from the paper feed cassette 11 as shown in FIG. 7.

When the supported portions 15C are subjected to the sliding displacement along the inclined surfaces 1F, the springs 16 are restored accordingly and hence the pressing forces F1 are gradually reduced. Therefore, when a moment around the supported portions 15C by the pressing force F1 and a moment around the supported portions 15C caused by the gravitational force applied to the holder arm 15 including the pickup roller 12 are balanced finally, the displacement of the holder arm 15 is stopped, and this state is maintained. Therefore, according to aspects of the invention, the shape of the supporting portions 1E is set so that the supported portions 15C reach the horizontal plane 11G when the both moments are balanced.

In contrast, when the paper feed cassette 11 is mounted on the apparatus body 1A, as shown in FIG. 5 and FIG. 6, the supporting portions 1E and the supported portions 15C (the holder arm 15) assume a non-contact state. Therefore, the holder arm 15 is subjected to the pivotal displacement about the shaft portion 13F according to the number (height) of the papers placed on the placing portion 11A.

In other words, according to aspects of the invention, since the pickup roller 12 is in contact with the paper placed on the placing portion 11A from the upper side, the direction of a moment caused by the gravitational force applied to the pickup roller 12 and the holder arm 15 (hereinafter, referred to as "gravity moment") is a direction to press the pickup roller 12 against the paper placed on the placing portion 11A.

When the drive belt 12A rotates and the pickup roller 12 rotates, a moment in the direction pressing the pickup roller 12 against the paper placed on the placing portion 11A (hereinafter, referred to as "tension moment") is applied to the holder arm 15 by a tensile force T1 generated in the drive belt 12A as shown in FIG. 6.

Accordingly, when the pickup roller 12 is rotated to feed the paper, the pickup roller 12 is pressed against the paper placed on the placing portion 11A by the gravity movement and the tension moment. Therefore, the pickup roller 12 is subjected to the pivotal displacement according to the increase or decrease of the number of papers while maintaining the state of being in contact with the paper.

When the paper feed cassette 11 is mounted on the apparatus body 1A, the supporting portions 1E are set to be positioned always on the opposite side from the placing portion 11A with respect to a common tangent line L3 between the pickup roller 12 and the separating roller 13B when viewed in the direction parallel to the shaft portion 13F as shown in FIG. 5 and FIG. 6. Here, the common tangent line L3 corresponds to an imaginary plane which comes into contact with the outer peripheral surface of the pickup roller 12 and the outer peripheral surface of the separating roller 13B when viewing the imaginary plane in the direction parallel to the shaft portion 13F.

3. Operation of the Paper Feed Device

According to aspects of the invention, the separating pad 13A is located at a position opposing the separating roller 13B, and is configured to apply a force opposing the pressing force F1 of the springs 16 (hereinafter referred to as "reaction force") to the separation roller 13B in a case where the paper feed cassette 11 is mounted on the apparatus body 1A.

Therefore, in a case where the paper feed cassette 11 is mounted on the apparatus body 1A, the separating roller 13B is brought into a state being pressed by the separating pad 13A, and the position of the separating roller 13B is maintained by the pressing force F1 and the reaction force are balanced, so that the holder arm 15 brought into the pivotal displacement about the separating roller 13B side as the center of the pivotal movement.

When the paper feed cassette 11 is removed from the apparatus body 1A, the reaction force is disappeared. Therefore, the holder arm 15 is subjected to the pivotal displacement about the portion supported by the supporting portions 1E provided on the apparatus body 1A by the pressing force F1 (the supported portions 15C) so that the separating roller 13B side is moved toward the separating pad 13A (that is, the paper feed cassette 11 side), so that the engagement between the drive gear 13E and the driven gear 13D is released.

At this time, the supported portions 15C, that is, the center of pivotal movement is located at the position between the pickup roller 12 and the separating roller 13B. Therefore, when the separating roller 13B side is subjected to the pivotal displacement toward the paper feed cassette 11, the pickup roller 12 is on the contrary subjected to the pivotal displacement in the direction away from the paper feed cassette 11, and this state is maintained (See FIG. 7). Therefore, the retracted state of the pickup roller 12 can be maintained without providing a mechanism for constraining the pickup roller 12 at the retracted position separately.

At the retracted position, as shown in FIG. 7, the lower end position of the pickup roller 12 is located above an upper end position 11C of the placing portion 11A. Therefore, the interference between the paper feed cassette 11 and the pickup roller 12 is avoided when the paper feed cassette 11 is removed from the apparatus body 1A.

Therefore, according to aspects of the invention, the pickup roller 12 may be retracted with a simple structure, and maintained in the retracted state easily, so that the reduction of cost of manufacturing of the paper feed device 10 and the image forming apparatus 1 is achieved.

When the paper feed cassette 11 is removed from the apparatus body 1A, the engagement between the drive gear 13E and the driven gear 13D is released. Therefore, the holder arm 15 is subjected to the pivotal displacement of the holder arm 15 easily without receiving a resistant force from the drive gear 13E when the holder arm 15 is pivoted to the retracted position.

In contrast, when the paper feed cassette 11 is mounted to the apparatus body 1A, the separating roller 13B is pressed by the separating pad 13A. Therefore, the shaft portion 13F is fitted into the depressed portions 1C while resiliently deforming the springs 16. Therefore, the shaft portion 13F is positioned and fixed while the outer peripheral surface is constrained in three directions by the depressed portions 1C as shown in FIG. 4.

According to aspects of the invention, the distance L1 of the holder arm 15 from the supported portions 15C supported by the supporting portions 1E to the center of rotation of the pickup roller 12 is larger than the distance L2 from the supported portions 15C to the point of action P1 of the pressing force F1. Therefore, a large amount of displacement of the pickup roller 12 can be achieved without increasing the amount of displacement of the point of action P1, so that the pickup roller 12 can be retracted reliably.

According to aspects of the invention, when the paper feed cassette 11 is mounted on the apparatus body 1A, the supporting portions 1E and the holder arm 15 are brought into a non-contact state. In contrast, when the paper feed cassette 11 is removed from the apparatus body 1A, the supporting portions 1E come into contact with the holder arm 15 and support the holder arm 15 so as to be pivotable. Therefore, such event that the number of papers placed on the placing portion 11A is increased and the holder arm 15 and the supporting portions 1E interfere with each other correspondingly and the pivotal displacement of the pickup roller 12 (the holder arm 15) is impaired at the time of pivotal displacement of the pickup roller 12 about the separating roller 13B is prevented.

According to aspects of the invention, when the paper feed cassette 11 is mounted on the apparatus body 1A, the supporting portions 1E are always located on the opposite side from the placing portion 11A with respect to the common tangent line L3 between the pickup roller 12 and the separating roller 13B. Therefore, interference between the paper to be transported and the supporting portions 1E is avoided, and hence the paper can be transported and fed satisfactorily.

According to aspects of the invention describe above, in the state in which the paper feed cassette 11 is removed from the apparatus body 1A, the holder arm 15 is supported by using the springs 16. However, the invention is not limited thereto and, for example, a holding portion of an elongated hole shape for holding the shaft portion 13F may be provided.

According to aspects of the invention described above, when the paper feed cassette 11 is removed from the apparatus body 1A, the engagement between the drive gear 13E and the driven gear 13D is released. However, the invention is not limited thereto.

What is claimed is:

1. A sheet feeding device comprising:

a sheet cassette including a placing portion configured to accommodate stacked sheets;

a pickup roller configured to individually feed the stacked sheets by rotating;

a separating pad configured to apply a predetermined transporting resistance to a sheet fed by the pickup roller;

a separating roller configured to contact the sheet fed by the pickup roller and to press the fed sheet against the separating pad;

a holder arm which holds the pickup roller and the separating roller, the holder arm being configured to pivot about a rotational axis of the separating roller when the sheet cassette is mounted;

an urging member configured to urge the separating roller toward the separating pad; and a supporting portion configured to support a specified portion of the holder arm positioned between the pickup roller and the separating roller, wherein the supporting portion and the specified portion are configured such that:

when the sheet cassette is removed, the supporting portion supports the specified portion of the holder arm at a supporting position and the pickup roller is positioned at an upper position corresponding to the supporting position where the specified portion of the holder arm is supported, and when the sheet cassette is mounted to the sheet feeding device, the specified portion is moved so as not to be supported by the supporting portion, and wherein the urging member is configured to, in response to removal of the sheet cassette, move the separation roller and the holder arm from respective first positions to respective second positions, and the supporting portion is configured to guide the specified portion of the holder arm to the supporting position, thereby moving the pickup roller to the upper position.

2. The sheet feeding device according to claim 1, wherein the pickup roller and the separating roller are configured to contact a same side of the sheet.

3. The sheet feeding device according to claim 1, wherein a distance from the specified portion, when supported by the supporting portion, to a rotational axis of the pickup roller is larger than a distance from the specified portion to a rotational axis of the separation roller.

4. The sheet feeding device according to claim 1, wherein the specified portion separates from the supporting portion when the sheet cassette is mounted, while the specified portion contacts and is supported by the supporting portion when the sheet cassette is removed.

5. The sheet feeding device according to claim 1, wherein the supporting portion is positioned on an opposite side from the placing portion relative to a common tangent line between the pickup roller and the separating roller when the sheet cassette is mounted.

6. The sheet feeding device according to claim 1, wherein, in response to mounting the sheet cassette, the separation pad urges the separation roller and moves the separation roller and the holder arm back to their respective first positions, thereby moving the pickup roller down toward the placing portion of the sheet cassette.

7. The sheet feeding device according to claim 6, further comprising a receiving portion configured to receive the separation roller urged by the separation pad when the sheet cassette is mounted.

8. The sheet feeding device according to claim 1, wherein the urging member includes a torsion spring.

9. The sheet feeding device according to claim 1, wherein the specified portion includes a protrusion.

10. The sheet feeding device according to claim 1, wherein the sheet cassette includes the separating pad.

11. An image forming apparatus comprising:

a sheet feeding device according to claim 1, and an image forming unit configured to form an image on a sheet fed from the sheet feeding device.

12. A sheet feeding device comprising:

a pickup roller configured to individually feed the stacked sheets by rotating;

a separating pad configured to apply a predetermined transporting resistance to a sheet fed by the pickup roller;

a separating roller configured to contact the sheet fed by the pickup roller and to press the fed sheet against the separating pad;

a holder arm which holds the pickup roller and the separating roller, the holder arm being configured to pivot about a rotational axis of the separating roller when a sheet cassette is mounted;

an urging member configured to urge the separating roller toward the separating pad; and a supporting portion configured to support a specified portion of the holder arm positioned between the pickup roller and the separating roller, wherein the supporting portion and the specified portion are configured such that:

when the sheet cassette is removed, the supporting portion supports the specified portion of the holder arm at a supporting position and the pickup roller is positioned at an upper position corresponding to the supporting position where the specified portion of the holder arm is supported, and when the sheet cassette is mounted to the sheet feeding device, the specified portion is moved so as not to be supported by the supporting portion, and wherein the urging member is configured to, in response to removal of the sheet cassette, move the separation roller and the holder arm from respective first positions to respective second positions, and the supporting portion is configured to guide the specified portion of the holder arm to the supporting position, thereby moving the pickup roller to the upper position.

13. A sheet feeding device comprising:

a sheet cassette including a placing portion configured to accommodate stacked sheets;

a pickup roller configured to individually feed the stacked sheets by rotating;

a separating pad configured to apply a predetermined transporting resistance to a sheet fed by the pickup roller;

a separating roller configured to contact the sheet fed by the pickup roller and to press the fed sheet against the separating pad;

a holder arm which holds the pickup roller and the separating roller, the holder arm being configured to pivot about a rotational axis of the separating roller when the sheet cassette is mounted;

an urging member configured to urge the separating roller toward the separating pad, wherein the urging member includes a torsion spring; and a supporting portion configured to support a specified portion of the holder arm positioned between the pickup roller and the separating roller, wherein the supporting portion and the specified portion are configured such that:

when the sheet cassette is removed, the supporting portion supports the specified portion of the holder arm at a supporting position and the pickup roller is positioned at an upper position corresponding to the supporting position where the specified portion of the holder arm is supported, and when the sheet cassette is mounted to the sheet feeding device, the specified portion is moved so as not to be supported by the supporting portion.

* * * * *